US007504788B2

(12) United States Patent
Haab et al.

(10) Patent No.: US 7,504,788 B2
(45) Date of Patent: Mar. 17, 2009

(54) DEVICE WITH CONTROLLABLE DIVIDER ELEMENTS AND CONTROL METHOD

(75) Inventors: Gregor Haab, Baar (CH); Hans Wuthrich, Wettswil (CH); Marco Odermatt, Stans (CH)

(73) Assignee: Hawa AG, Mettmenstetten (CH)

( * ) Notice: Subject to any disclaimer, the term of this patent is extended or adjusted under 35 U.S.C. 154(b) by 558 days.

(21) Appl. No.: 11/259,102

(22) Filed: Oct. 27, 2005

(65) Prior Publication Data

US 2006/0103343 A1 May 18, 2006

(30) Foreign Application Priority Data

Nov. 12, 2004 (EP) ..... 04405700

(51) Int. Cl.
*E05F 15/10* (2006.01)

(52) U.S. Cl. ..... 318/286; 49/360; 160/1; 160/310; 340/310.11

(58) Field of Classification Search ..... 318/264–266, 318/272, 286, 459, 466–468; 49/36, 73.1, 49/324, 326, 358, 360–363, 463–465; 160/1, 160/87, 178.1 R, 178.1 V, 196.1, 218, 309, 160/310; 340/310.11
See application file for complete search history.

(56) References Cited

U.S. PATENT DOCUMENTS 5,152,332 A * 10/1992 Siener ..... 160/188
6,313,594 B1 * 11/2001 Janutta ..... 318/466
6,662,502 B2 * 12/2003 Janutta et al. ..... 49/143
7,228,664 B2 * 6/2007 Clark ..... 52/243.1

FOREIGN PATENT DOCUMENTS

EP 0 953 706 A1 11/1999

* cited by examiner

*Primary Examiner*—Bentsu Ro
(74) *Attorney, Agent, or Firm*—Oliff & Berridge, PLC

(57) ABSTRACT

The device has at least one controllable divider element including a drive assembly guided within a track, the drive assembly being driven by an electric motor which is controllable by a central control unit and a local control unit, which units exchange data through an electric line located in the track and functioning as the power supply for the electric motor. According to the invention, a first direct voltage is provided in the central control unit, the voltage being connectable to the power supply line through a central switch which is actuated as a function of the data to be transmitted between the central and local control units, whereby, when the switch is opened, data are able to be transmitted from the local control unit to the central control unit. In addition, an especially advantageous initialization of the device is possible based on the method according to the invention.

16 Claims, 5 Drawing Sheets

DEVICE WITH CONTROLLABLE DIVIDER ELEMENTS AND CONTROL METHOD

The invention relates to a device with controllable divider elements, and a method serving to control the divider elements, as indicated in the preamble of Claims 1 or 8, respectively.

Glass or wooden walls, sliding panels, doors, or shutters—hereafter called divider elements—which are immovably mounted or attached so as to move on drive assemblies slidable along a running track, and are optionally rotatably mounted and/or stackable or parkable—are often employed to separate or configure rooms, or to close off room or window openings. Devices with divider elements, the drive assemblies of which are equipped with electric motors which are controllable by a control unit, are employed specifically in public buildings, commercial buildings and hotels. In order to be able easily to control multiple divider elements, a central control unit is preferably provided which exchanges data with local control units attached to the divider elements. The exchange of data can be implemented wirelessly or through the power supply lines provided to drive the electric motors.

EP 0 953 706 A1 discloses a device in which the drive motor and drive unit are located within the support profile of the divider element. In this device, the electric motors integrated in the divider element are supplied with alternating current. Transmission of the control signals is implemented by modulation and demodulation of a carrier signal. The transmission and control devices of this type are based on proven, usually standardized modules, the cost of which is comparatively low due to their wide level of use.

To effect operation, the known devices must be initialized, programmed and parameterized based on the configurations present. Usually, the local control units are provided with switching groups by which addresses are assigned to the divider elements or local control units. In addition, the number and width of the divider elements must be inputted according to which the departure times for the divider elements are calculated, as governed by the travel speeds and travel distances within or outside of the parking space or station in which the divider elements are stored in a stacked fashion, in order to open and close so as to prevent collisions from occurring. This process of initializing the device in each case involves a relatively high complexity/expense.

The purpose of the invention is therefore to create a simpler and further-improved device as well as an appropriate control method.

The device should be able to be implemented more cost-effectively and initialized with reduced complexity/expense, while ensuring interference-free communication between the central control unit and the decentralized control unit.

This purpose is achieved by a device and a method which have the features indicated in Claims 1 or 8, respectively. Advantageous embodiments of the invention are indicated in the remaining claims.

The device has at least one controllable divider element which is driven by a drive assembly retained within a track and by an electric motor controllable by means of a stationary central control unit and a local control unit connected to the divider element, which control units exchange data through an electric line provided in the track, the line functioning as the power supply for the electric motor.

According to the invention, a first direct voltage is provided in the central control unit, which direct voltage is connectable through a central switch to the power supply line, the switch being actuatable from a central sending unit as a function of the data to be transmitted from the central control unit to the local control unit. Provided in the local control unit is local receiving unit which is capable of detecting changes in the voltage applied to the power supply line. These detected changes are converted by a local processor according to a first transfer protocol into appropriate data. Based on the received data or instructions, a switch is actuatable by the local processor, by which switch the voltage applied to the power supply line is able to be supplied to the electric motor.

The first direct voltage provided in the central control unit, primarily for the purpose of supplying power to the electric motors, can be generated by an inexpensive power supply component, for example, by a power supply unit, to which an alternating voltage of a predetermined or randomly-chosen magnitude is able to be fed. No carrier signals or corresponding generators are required for the transmission of data between the central control unit and the at least one local control unit. Transmission is effected on the transmission side and receiving side using simple means, preferably, in the baseband. The reduction in the cost of the device is thus achieved by replacing complex transmission devices—even if these are standardized and therefore inexpensive—by simple power supply devices and simple transmission means which can be operated by inexpensive single-chip processors, for example, of the PIC 1× family from the company Microchip (see http://www.microchip.com).

Provided in the local control unit, which is preferably also equipped with at least one single-chip processor, is a local control unit by which data are able to be transmitted, during intervals in which the central switch is open, to a central receiving unit provided in the central control unit. The direct voltage source serving to supply the first direct voltage, which source has a low internal resistance and would affect data transmission from the local to the central control unit, is isolated during this transmission interval.

Transmission of data from the local to the central control unit is feasible using any approach desired. However, this transmission can be implemented in an especially advantageous approach by which a second direct voltage is connected within the central control unit through a central resistance to the power supply line, to which a local resistance within the local control unit is connectable by a second local switch which in turn is actuatable by the local control unit as a function of the data to be transmitted. A voltage divider is thus created by the local and central resistances interconnected through the power supply line after the local switch is closed, to which voltage divider a voltage is applied in the central control unit which is lower than the second direct voltage. Changes in the voltage at the voltage divider which correspond to the transmitted data are thus able to be detected in the central control unit. Detection of the voltage changes in the central or local control units is implemented by a comparator, for example, by an operational amplifier, to the inputs of which the signals to be detected and a reference voltage are applied.

The voltage applied to the power supply line is applied preferably through a diode to a capacitor which is connectable through the first local switch to the electric motor. The capacitor thus enables interruption-free supply of power to the electric motor. The capacitor is charged to the level of the first direct voltage, and supplies the necessary operating voltage during intervals in which the central switch is open and the first direct voltage is isolated from the power supply line. During intervals in which the central switch is open, the diode isolates the capacitor from the power supply line. This action could also be accomplished using a switch.

The electric motor is provided with a sensor, optionally a Hall sensor, by which the rotations and rotational direction of the rotor is able to be determined—and thus the path traveled by the divider element and the encountering of an obstacle, end stop, or adjacent divider element. The device according to the invention and the method thus allow, despite the device's simple construction, for precise individual control of all system-connected divider elements, thereby enabling these to be slid together and apart, as well as moved into and out of a parking space or station.

Transmission of data between the central control unit and local control unit can be implemented either synchronously or asynchronously. For example, time windows are statically or dynamically assigned to the local control units during which, for example, data can be transmitted to the central control unit either cyclically or upon interrogation. The data are exchanged between the control units, for example, within protocol frameworks which have the start and stop bits, and optionally, parity bits. In order to transmit a start bit, the central switch is preferably opened. After the start bit is detected and during the period of the start bit, the local control unit is thus able to transmit data to the central control unit by opening and closing the second local switch. The data are preferably transmitted, and optionally coded, according to a predetermined protocol. A data frame or data packet may have, for example, a start bit, eight data bits, a parity bit, and two stop bits. In addition, one or more bits may be reserved within the frame for use by the local control units.

During initialization of devices according to the invention or, for example, of devices known from EP 0 953 706 A1, various parameters must be adhered to in order to achieve the fast possible extension and retraction of the divider elements, while simultaneously avoiding collisions during extension from the parking space. A comparison of FIGS. 7 and 8 reveals that the time required for extension from Parking space P is essentially determined by the width b1, b2 of divider elements 1A, . . . , 1D; 1A', . . . , 1D'. Divider elements 1A', . . . , 1D' shown in FIG. 7 require significantly more time than the divider elements 1A, 1D shown in FIG. 8. In addition to the width b1, b2 of divider elements 1, what must also, for example, be taken into account is the travel speed inside and outside the parking space, the spacing within the parking space, the spacing during opening and closing, and the path of the tracks 3. Initialization has up to now proven to be especially complicated whenever divider elements 1 were used that have different widths b1, b2. The initialization of each device that has been supplied according to the specifications of the user therefore requires a proper accounting of all relevant factors.

Using the method according to the invention, however, it is significantly simpler to implement initialization without the determination and input of the above-mentioned parameters.

The following discussion explains the invention in more detail based on the drawings:

FIG. 1 shows a device with at least one controllable divider element 1 which is retained by a drive assembly 2 guided within a track 3, and which is driven by an electric motor 15 which is controllable by a central control unit 1000 and a local control unit 100;

Figures 3, 3A:
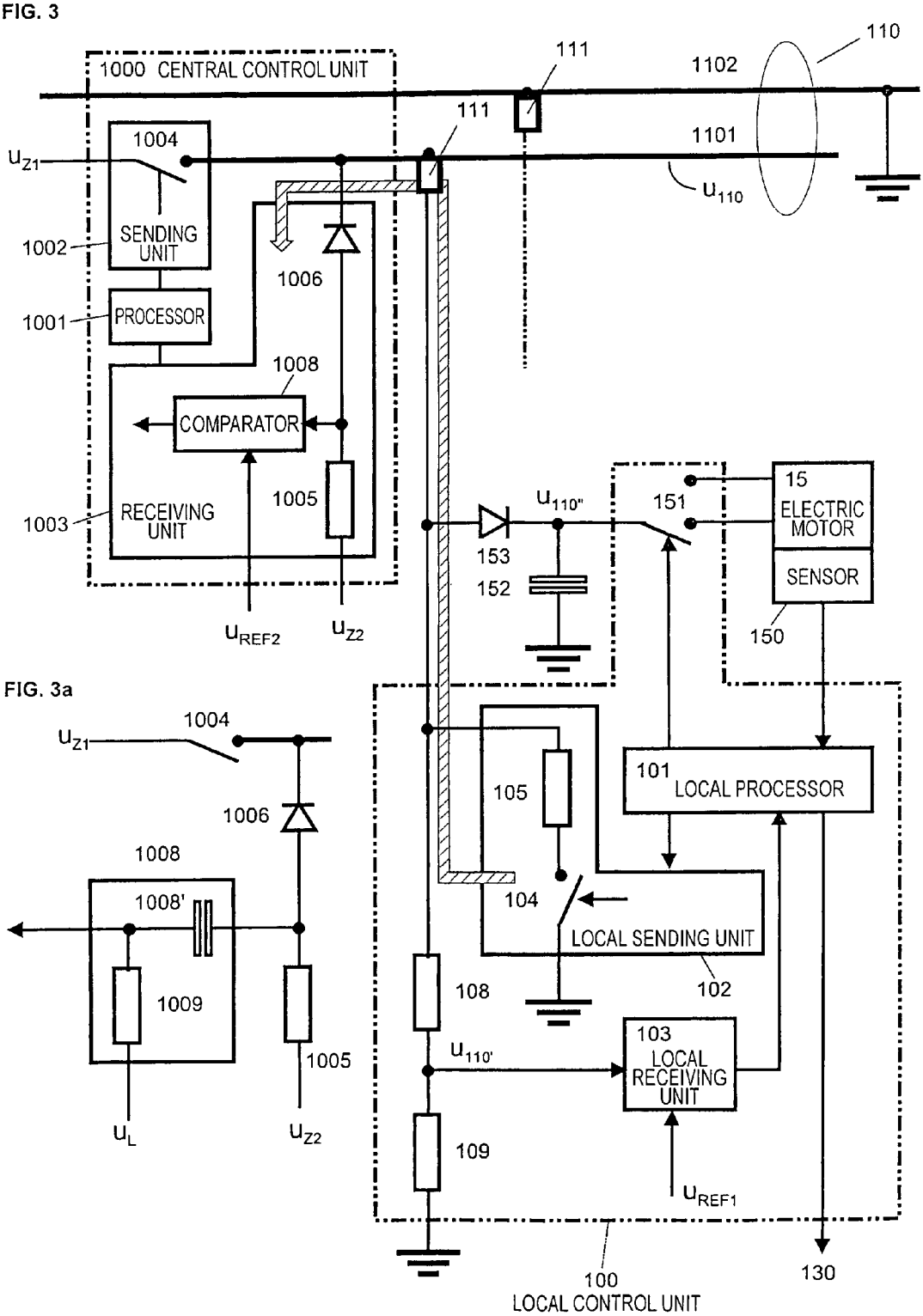
FIG. 3 is the electrical schematic diagram for the device in a second configuration.
Figure 4:
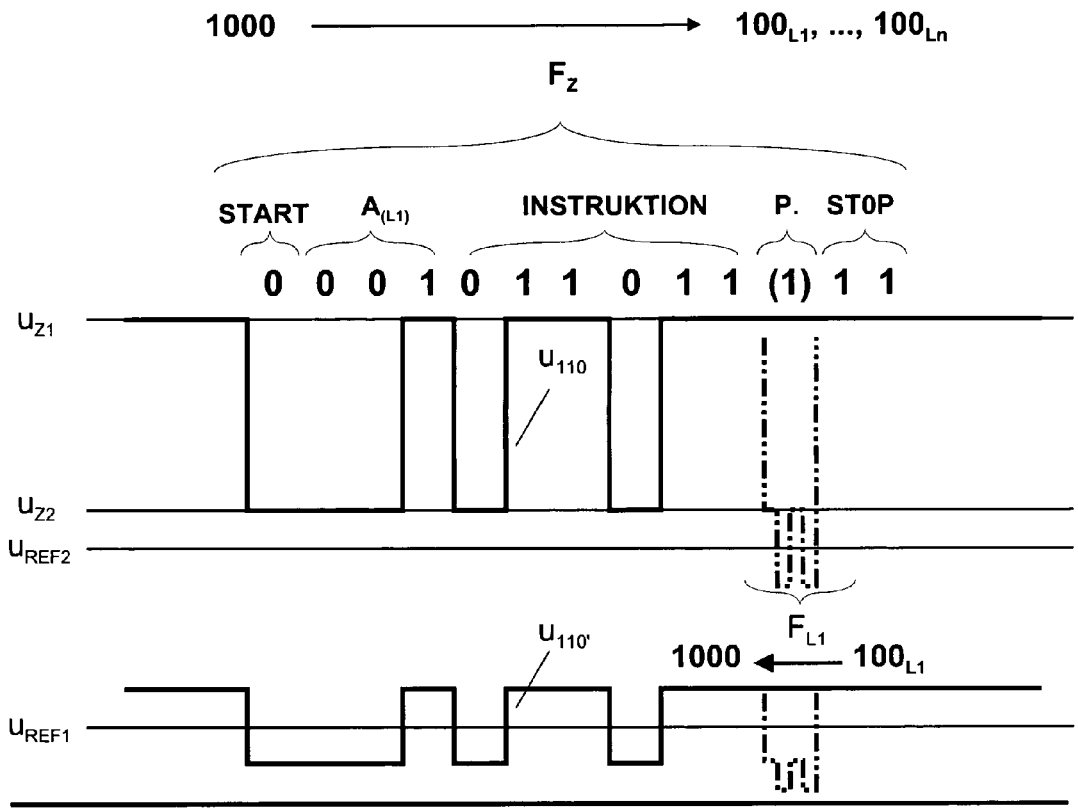
Figure 5:
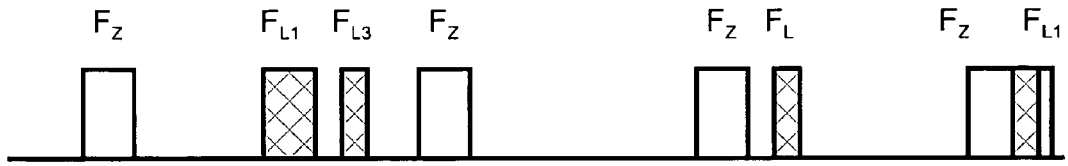
Figure 6:
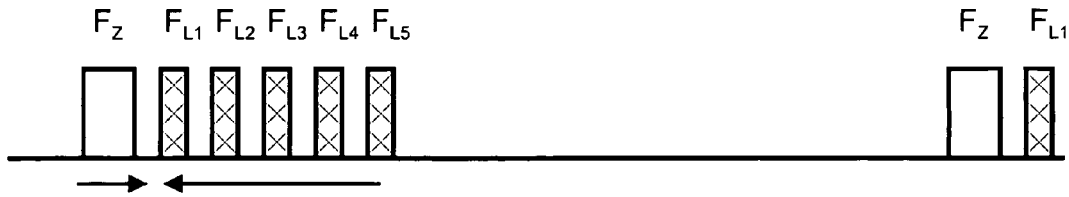
Figure 7:
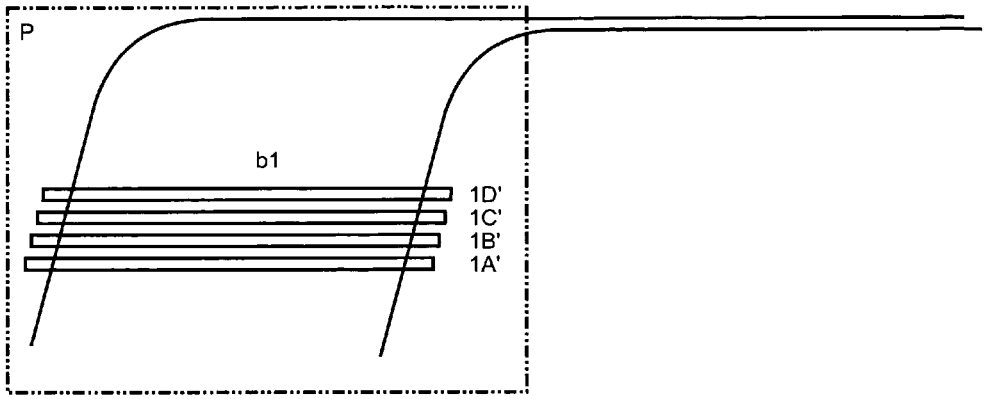
Figure 8:
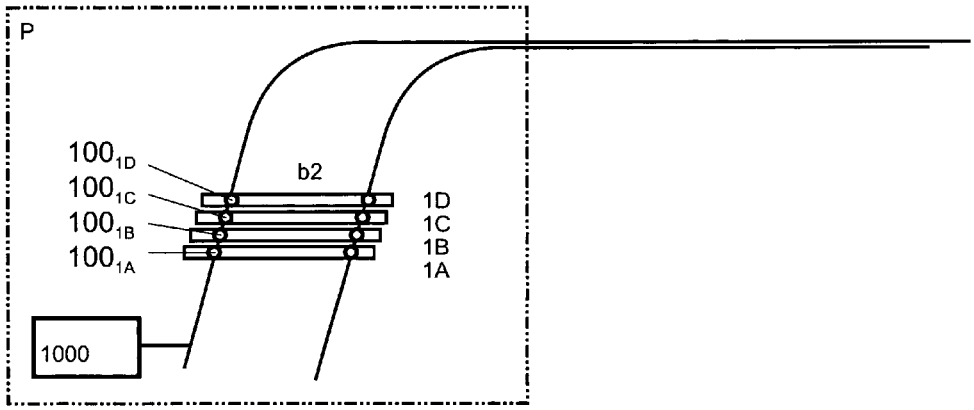
Figure 9:
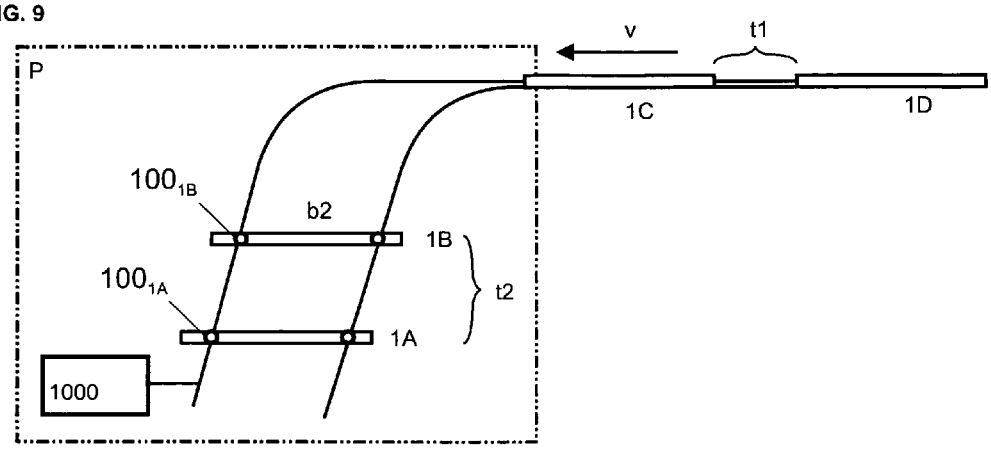

FIG. 3*a* shows a central receiving unit 1003 in the form of a preferred design;

FIG. 4 shows the path of the voltage on power supply line 110 during the bidirectional transmission of data;

FIG. 5 shows the data frame for asynchronous data transmission;

FIG. 6 shows the data frame for synchronous or semi-synchronous data transmission;

FIG. 7 shows wide divider elements 1A', . . . , 1D' retracted into a parking space;

FIG. 8 shows narrow divider elements 1A, . . . , 1D retracted into a parking space;

FIG. 9 shows the divider elements 1A, . . . , 1D of FIG. 8 during initialization of the device.

Figure 1:
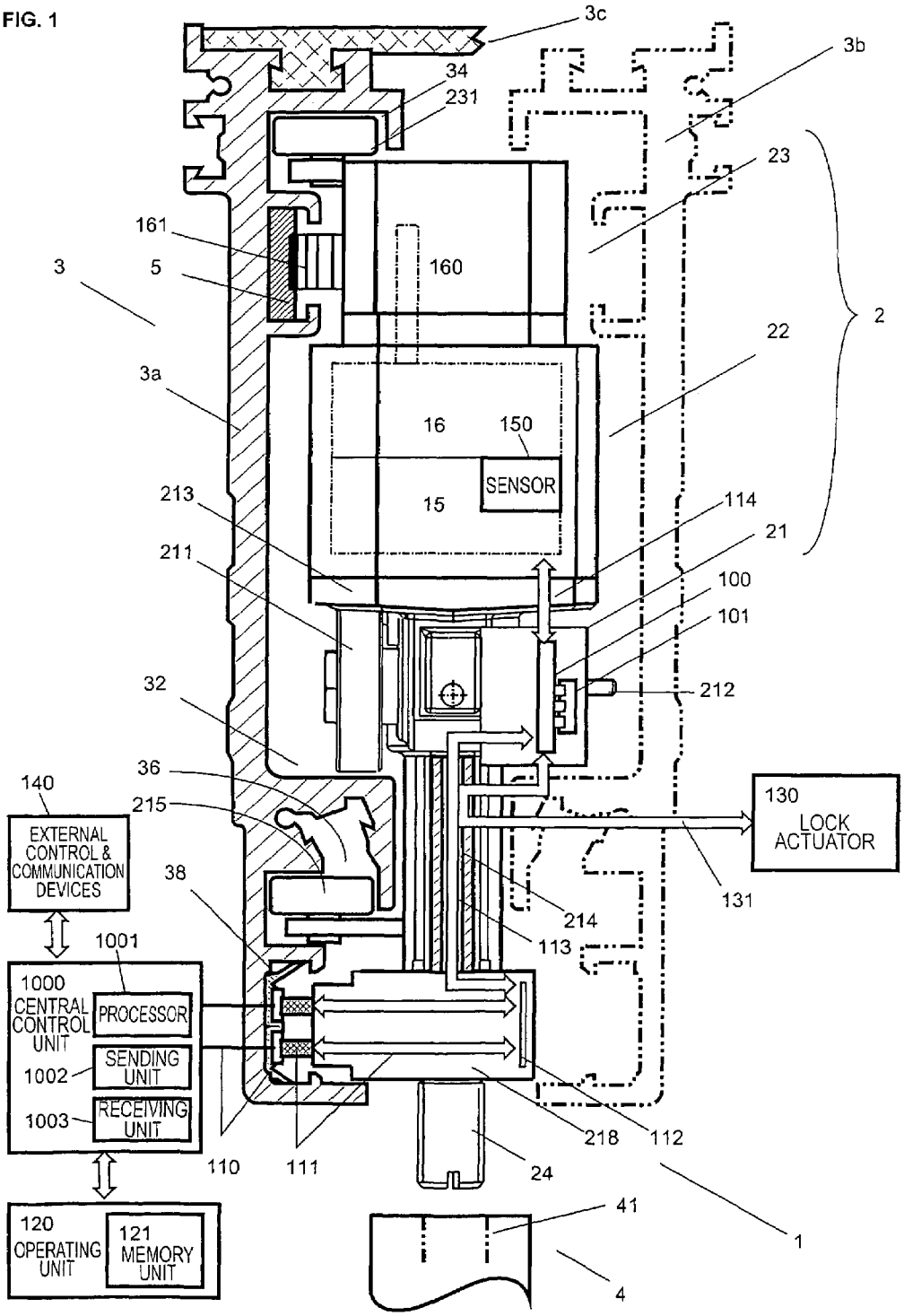

FIG. 1 shows a device with a divider element, the drive assembly of which is described in European Patent Application no. 04405607. The subject matter of this patent application is incorporated by reference in the present application. The drive assembly 2 shown in FIG. 1, which is guided by two running wheels 211 on a running surface 32 of a track 3 and with guide wheels 215, 231 in channels 34, 36 of track 3, and which is connected by a load shaft 24 and by a mounting device 41—for example, to a wood, plastic or glass plate 4—has a drive shaft 160 driven by an electric motor 15 and a gearing 16, the drive shaft being coupled by a toothed gear 161 to a toothed belt 5 provided in track 3. The drive assembly 2 has a traveling assembly unit 21 in which drive shaft 24, extending vertically downward from drive assembly 2, and shafts 212 oriented perpendicular thereto are held for running wheels 211. At the top, traveling assembly unit 21 has a head piece 213 which is connected to a drive unit 22 in which electric motor 15 and gearing 16 are arranged such that drive shaft 160 extends vertically upward from drive assembly 2 such that the toothed gear 91 mounted on drive shaft 160 engages toothed belt 51 retained above the running surface 12 of the track 1. Mounted on drive unit 22 is a guide unit 23 which retains upper guide wheel 231.

The bottom of traveling assembly unit 21 is additionally provided with a contact module 218 having contact pins 111 provided therein which run along a power supply line 110 located within a channel 38 of the track and contact this line. Power supply line 110, which is composed of two lines, is connected on one side to a stationary or central control unit 1000, and on the other side to a local control unit 100 provided on the at least one divider element 1, which local control unit serves in particular to control electric motor 15 located on drive assembly 2 and, optionally, to control an actuator 130 of a locking means for divider element 1. In the present embodiment of drive assembly 2, the connection of power supply line 110 to local control unit 100 is effected through contact pins 111 attached to mounting plate 112 and through a connecting line 113 provided in a channel 214 of drive assembly 2. Routed through this or an additional channel 214 is another connecting line 131 by which local control unit 100 is connected to the optionally provided actuator 130 for the locking means. The connection of control unit 100 to electric motor 15 and to a sensor 150 by which the rotations and rotational direction of the rotor of electric motor 15 are detected is effected through another connecting line 114.

Sensor 150 connected to electric motor 15 is preferably a Hall sensor which is located, for example, between the rotor and a permanent magnet that supplies a magnetic field perpendicularly to the Hall element through which an electric current flows. Whenever the field strength of the magnetic field changes due to motion by the rotor, the electrons, which are driven by a longitudinal voltage applied to the element, are diverted more strongly perpendicularly to the direction of the current. As a result, a Hall voltage in the millivolt range is generated which is fed, preferably converted to a logic level, to local control unit 100 and evaluated there in order to stop the rotations of motor 15 and the corresponding displacement of divider element 1.

Central control unit 1000 is connectable to an operating unit 120 by which the device can be initialized. Provided in operating unit 120 is a memory unit 121 in which preferably text modules are stored which are callable through symbols transmitted by central control unit 1000 such that the memory requirement in central control unit 1000 is reduced. In addition, central control unit 1000 can be connected to additional external devices such as sensors.

Figure 2:
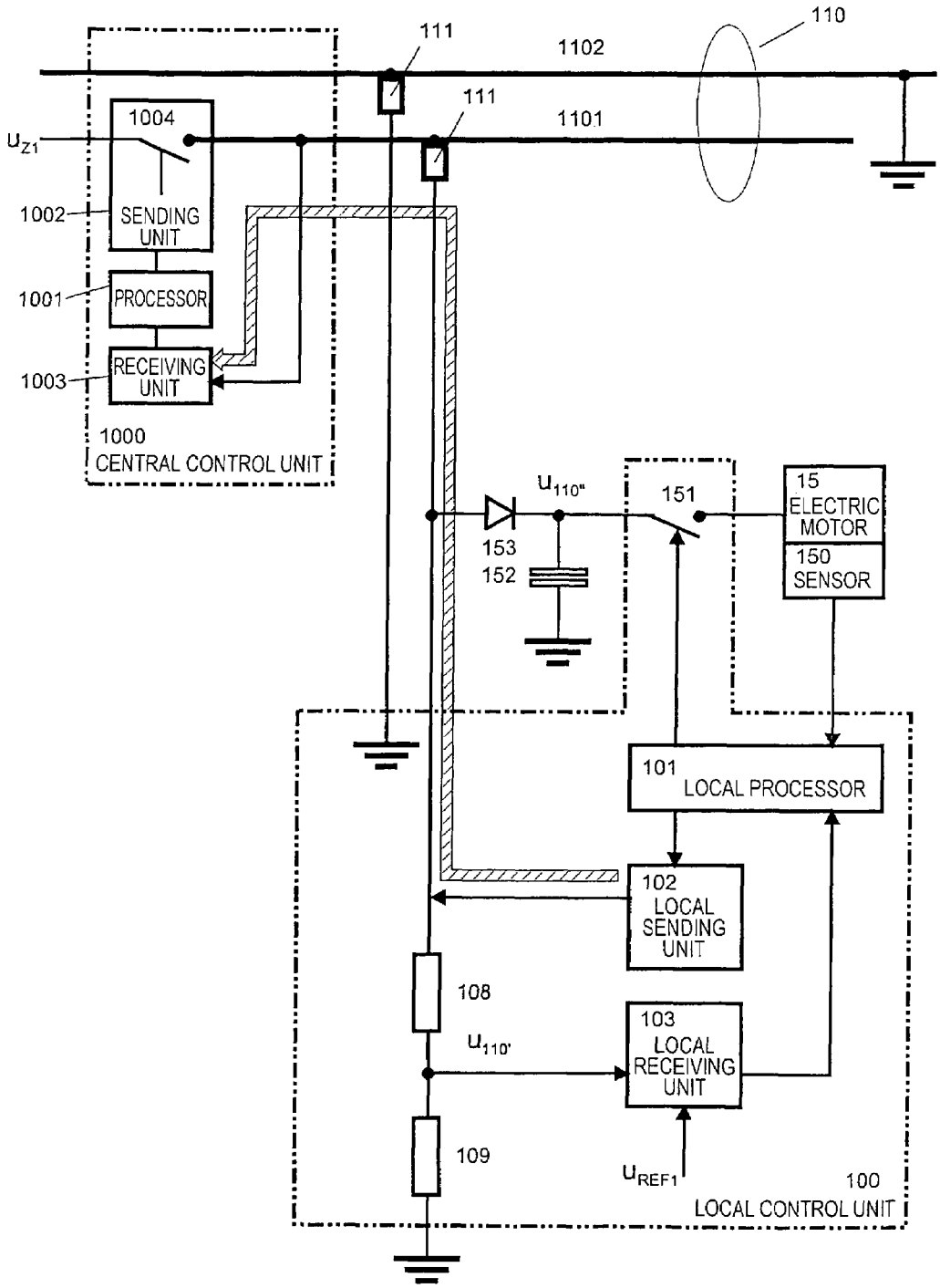
FIG. 2 is the electrical schematic diagram for the device in a first configuration.

The following discussion explains in more detail remaining aspects of the design of control units 1000, 100, and the control method according to the invention, based on FIGS. 2 and 3.

As FIG. 2 illustrates, central control unit 1000 has a processor 1001 which is connected to a sending and receiving unit 1002, 1003. Sending unit 1002 has a central switch 1004 by which a first direct voltage $u_{Z1}$, for example, 40V, is able to be connected to the conductors 1101, 1102 of power supply line 110. As was already mentioned, local control unit 100 of each divider element 1 is connected by contact pins 111 to power supply line 110. A capacitor 152 is charged through a diode 153 with a voltage $u_{110}$ applied to power supply line 110, which capacitor is connectable by a first local switch 151 to electric motor 15. As long as central switch 1004 is permanently closed, voltage $u_{110}$ at power supply line 110 and voltage $u_{110'}$ at capacitor 152, which serves as the operating voltage for electric motor 15, are equal to first direct voltage $u_{Z1}$. Through the action of capacitor 152, operating voltage $u_{110'}$ for electric motor 15 is kept practically constant even when local switch 1004 is opened briefly for the transmission of data. Diode 153 here prevents any discharging of capacitor 152 in the direction of power supply line 110 whenever voltage $u_{110}$ applied thereto drops.

Transmission of data from the central to the local control unit 1000 or 100 is effected according to the invention through power supply line 110 when central switch 1004 is opened or closed according to the digitally available data to be transmitted. Detection of the data to be transmitted is implemented in local control unit 100, preferably by monitoring a voltage $u_{110'}$ applied at a voltage divider formed by two resistances 108, 109, by which voltage divider power supply line 110 is terminated locally. The voltage $u_{110'}$ applied a voltage divider 108, 109 is compared in a local receiving unit 103, preferably by a comparator, for example, an operational amplifier, with a reference voltage $U_{REF1}$ such that voltage changes are able to be detected and corresponding signals are able to be supplied to local processor 101. Based on the instructions provided, local processor 101 is able to actuate first local switch 151 or electric motor 15, or, while central switch 1004 is open, to transmit data to central control unit 1000.

Any method can be employed to transmit data from local control unit 100 to central control unit 1000. In an especially advantageous approach, however, this transmission can be implemented using the device shown in FIG. 3 in which power supply line 110 is connected permanently to a second direct voltage $u_{Z2}$ (for example, 24V, $u_{Z2}<u_{Z1}$) through a diode 1006 and a resistance 1005, which voltage is applied to power supply line 110 as soon as central switch 1004 is opened. In local control unit 100, a local resistance 105 is able to be connected by a second local switch to power supply line 110, which switch is actuatable by local sending unit 102 as a function of the data to be transmitted. Through the action of local and central resistance 105, 1005 interconnected through power supply line 110, a voltage divider 105, 1005 is thus created after local switch 104 is closed, such that voltage $u_{110}$ at power supply line 110 drops relative to second direct voltage $u_{Z2}$ ($u_{Z2}<u_{110}$). Changes in voltage $u_{110}$ at power supply line 110 are able to be detected in central receiving unit 1003, for example, by means of a comparator 1008 and a second reference voltage $U_{REF2}$, then converted in central processor 1001 to corresponding data.

FIG. 3*a* shows a central receiving unit 1003 having a capacitor 1008' which is connected on one side through resistance 1005 to second direct voltage $u_{Z2}$ and on the other side through a resistance 1009 to a logic voltage $u_L$. As long as no data are being transmitted, the capacitor is charged to differential voltage $u_{Z2}$-$u_L$. If central switch 1004 is now opened and second local switch 104 is closed, the voltage applied on the input side at capacitor 1008' changes, and thus the voltage at the output of receiving unit 1003 changes as well. Voltage changes can thus be detected locally and centrally using one of several methods.

For the coding and transmission of the data, transfer protocols are provided on the basis of which the received signals can be correctly interpreted, and collisions during transmission of data or multiple access actions can be avoided. For example, data frames are transmitted by central control unit 1000 which have one start bit, and one or more stop bits. The transmission from the local control units 100 to the central control unit 1000 can be implemented during reception of the stop bit, or within time windows which are provided after transmission of the data frame and are, for example, permanently assigned to the individual control units. For example, the response to an interrogation transmitted with a data frame occurs subsequently within the next data frame, or within a time window which is specifically assigned to a local control unit 100.

An example of the data transmission between central control unit 1000 and local control units 100 is shown in FIG. 4. Upon actuation of central switch 1004, a data frame $F_Z$ having one start bit, three address bits, six data bits (i.e., an instruction), one parity bit, and two stop bits is transmitted by central control unit 1000. To transmit data bits=0, central switch 1004 is opened such that voltage $u_{110}$ at current track 110 drops from first direct voltage $u_{Z21}$ to second direct voltage $u_{Z2}$. What must be taken into account here is that operating voltage $u_{110'}$ at capacitor 152 is higher than voltage $u_{110}$ at current track 110 so that diode 153 blocks, and thus isolates capacitor 152 from current track 110. FIG. 4 thus shows the path of voltage $u_{110}$ at current track 110 during transmission of data frame $F_Z$. Through the actuation of second local switch 104, data can be transmitted to central control unit 1000 during periods in which second direct voltage $u_{Z2}$ is applied at current track 110 or in which data bits=0 (an inversion of the process is of course possible whereby the switch is opened at data bit=1). In other words, local control units 100 are able to transmit data immediately upon detection of the start bit. In order to avoid collisions, central control unit 1000 can insert in the transmitted data frame $F_Z$ the address of the local control unit 100 from which a response is expected. This local control unit 100 is thus able, after detection of its address, to immediately transmit data within the frame at the position of a (or multiple) correspondingly assigned bits, or within a following frame or time window, with the result that voltage $u_{110}$ is reduced at current track 110 during transmission of the corresponding data bit. For example, instead of the parity bit (switch 1004 open), an "interrogation bit" of the same polarity can always be sent which is utilized by local control unit 100 as the send window. In central control unit 1000, the corresponding data can be detected by comparing voltage $u_{110}$ at current track 110 to a second reference voltage $u_{REF2}$.

FIG. 5 shows the asynchronous transmission of data frames $F_Z$ to local control units 100 and the responses $F_L$ of these units outside or within data frames $F_Z$. Local control units 100 are preferably prompted therein for responses.

FIG. 6 shows the synchronous transmission of data frames $F_Z$, $F_{L1}$, $F_{L2}$, . . . between central control unit 1000 and local control units 100. However, a semi-synchronous transmission of data is also feasible in which data frames are sent asynchronously from central control unit 1000, and the time windows for the delivery of data are provided by local control units 100, for example, at fixed individual intervals from the stop bit of received data frame $F_Z$.

The following discussion explains in more detail the method to initialize the device. At operating unit 120, the user receives the instruction to extend divider elements 1A, . . . , 1D completely out of the parking space. The instruction then follows to move divider elements 1A-1B-1C-1D in the correct sequence manually towards parking space P. The movements of individual divider elements 1A-1B-1C-1D are detected by sensor 150 and reported by the relevant local control unit 100 to central control unit 1000.

Central control unit 1000 is thus able to record the rank number of the local control unit, or of the relevant divider element 1A, and assign to this number an address which is stored centrally and locally. The addressing of divider elements 1A, . . . , 1D is thus able to be implemented quickly and simply without the need for any intervention in the device.

As a result of the manual displacement of divider elements 1A, . . . , 1D, central control unit 1000 is also notified of the direction in which divider elements 1A, . . . , 1D are being displaced toward the associated park position, with the result that that the individual divider elements 1A, . . . , 1D are each able to be extended from the associated parking space P or retracted into the associated parking space P, each time in the correct direction, or, in the case of multiple parking spaces, in different directions.

Within the parking space, divider elements 1A, . . . , 1D are moved sequentially by central control unit 1000 towards an associated inner end stop which may be formed by an adjacent divider element 1. As a result, the end position of each divider element 1A, . . . , 1D within the parking space can be precisely determined, as can the element's specific position outside of the parking space, based on the subsequent monitoring of rotor rotations made by drive motor 15, 150. In preferred embodiments, this information is used to reduce the travel speed of divider elements 1A, . . . , 1D before reaching the target position, possibly an end position, or to position divider elements 1A, . . . , 1D as required.

After determining the end positions within the parking space, divider elements 1A, . . . , 1D are extended by central control unit 1000 from the parking space until they meet an associated outer end stop, for example, an adjacent divider element 1, or a stop limiting an opening. Since central control unit 1000 does not yet know the position of the relevant outer end stop, these initialization runs are effected at reduced speed. After the described initialization runs have been implemented, the addresses, the sequence and displacement directions of divider elements 1A, . . . , 1D, and the positions of the respective inner and outer end stops, and the respective positions of divider elements 1A, . . . , 1D (at or between the end stops) are stored, at least in central control unit 1000, preferably also in local control units 100. At least when the system switches off, these data are preferably stored in a nonvolatile memory. In the event data are lost, the appropriate initialization runs must be repeated. When the already initialized device is restarted, the stored positions of divider elements 1A, . . . , 1D adjoining an inner or outer end stop are preferably verified by moving them against the appropriate end stop.

In order to operate the device, however, yet additional data are required by which collisions can be avoided during extension of divider elements 1A, . . . , 1D out of the parking space. To this end, divider elements 1A, . . . , 1D adjoining the outer end positions after the first initialization phase, as shown in FIG. 9, are transported by central control unit 1000 at a predetermined speed v and predetermined time intervals t1 toward the associated park position. The time intervals t2 of their arrival at the park positions are at the same time recorded and stored centrally or locally. The arrival of a divider element 1A is able to be determined by sensor 150 which issues an appropriate signal as soon as divider element 1A hits a stop and the rotor of electric motor 15 stops. By using this method, corresponding limit switches or other sensors can be dispensed with—along with the related cost.

When the device is in operation, divider elements 1A, . . . , 1D are extended at the thus-determined time intervals t2 or delays from the park positions. To this end, central control unit 1000 is able to control each individual divider element 1A, . . . , 1D sequentially. If the delay times $t2_{1A}$, $t2_{1B}$, . . . assigned to divider elements 1A, . . . , 1D are stored in local control units 100, these are able to determine the element-specific departure time according to a start signal transmitted by central control unit 1000.

This initialization method eliminates the need for the complex parameterization of the device which can only be undertaken by appropriately trained personnel. In addition, this method takes into account parameters, for example, special curve runs, which are virtually impossible to take into account using the known parameterization. In the event individual parameters are nevertheless entered, the corresponding initialization runs can be omitted.

The device according to the invention and the control method have been described and presented in the form of preferred embodiments. However, other embodiments using the knowledge of one skilled in the art can be implemented based on the teaching of the invention. In particular, it is possible to employ different protocols for the codings and synchronous or asynchronous transmissions of data. What is important is that only relatively small quantities of data are transferred between central control unit 1000 and local control units 100 so as to easily enable additional functionalities to be implemented. Although preferably only one processor 101, 1001 is provided in control units 100, 1000, multiple processors may be employed to which various functionalities are assigned. Extensive integration of the sending and receiving units in processors 1001, 101 is, of course, also possible. For example, efficient drivers for local and central switches 1004, 104, 151, and/or comparators can be integrated in processors 1001, 101. Additional switches can be employed in place of diodes 153 and 1006. In addition, various power supply devices and electric motors can be used which are appropriately wired to produce the desired rotational speeds and directions. For example, operating voltage $u_{110''}$ can be applied to an appropriate terminal in order to change the rotational direction. The control device according to the invention and the control method are, of course, also advantageously applicable to other drive assemblies and drive systems, including, for example, the device disclosed by EP 0 953 706 A1.

LIST OF REFERENCE NOTATIONS

1 divider element with drive assembly and plate 72
1000 central control unit
1001 central processor
1002 central sending unit

1003 central receiving unit
1004 central switch
1005 central resistance
1006 diode
1008 comparator
1008' capacitor
1009 resistance
100 local control unit
101 local processor
102 local sending unit
103 local receiving unit
104 local switch
105 local resistance
108, 109 voltage divider
110 power supply line with lines 1101, 1102
1101 switched line
1102 grounded line
111 elastically mounted contact pins
112 mounting plate
113 connecting line routed in channel 214
114 line to electric motor 15 and sensor 150
120 operating unit
121 memory unit with text
130 lock actuator
131 line to lock actuator
140 external control and communications devices
15 electric motor
150 sensor, for example, Hall sensor
16 gearing
160 drive shaft
161 toothed gear
2 drive assembly with drive motor
21 traveling assembly unit
211 running wheels on traveling assembly unit 21
212 shaft for running wheels 211
213 head piece
214 channels to route electrical lines
215 lower guide elements on traveling assembly unit 21
218 contacting module
22 drive unit of drive assembly 2
23 guide unit
24 connecting element or screw held rotatably within traveling assembly unit 21
3 running track
3*a*, 3*b*, 3*c* parts of running track 1
32 running surface for running wheels 211
34 guide channel to accommodate upper guide elements
36 guide channel to accommodate lower guide elements
4 wood, metal, plastic and/or glass plate
41 mounting profile, attachment device
414 power supply lines
415 channels for spring-loaded contact pins 411
416 screw to mount contacting module 41
417 spring elements
42 control module
422 plate, shield
421 control lines
431 Hall element
44 gearing
5 toothed belt

The invention claimed is:

1. A device with at least one controllable divider element which is driven by a drive assembly retained within a track, and by an electric motor which is controllable by a central control unit and a local control unit, each of which has a central or local processor and exchanges data through an electric line provided in the track, the line functioning as the power supply for the electric motor, wherein provided in the central control unit is a first direct voltage which is connectable through a central switch to the power supply line, the switch being actuatable by a central sending unit as a function of the data to be transmitted from the central control unit to the local control unit; and that provided in the local control unit is local receiving unit which is capable of detecting changes in the voltage applied to the power supply line, which changes are convertible by a local processor into appropriate data, the processor being connected to a first local switch by which the voltage applied to the power supply line is connectable to the electric motor.

2. The device according to claim 1, wherein provided in the local control unit is a local sending unit by which data are able to be transmitted through the power supply line to a central receiving unit provided in the central control unit during intervals in which the central switch is opened.

3. The device according to claim 2, wherein in the central control unit a second direct voltage is permanently connected through a central resistance to the power supply line to which a local resistance is able to be connected by a second local switch in the local control unit, the switch being actuatable by the local sending unit as a function of the data to be transmitted.

4. The device according to claim 3, wherein the central receiving unit is capable of detecting changes in the voltage applied to the power supply line, the changes being converted by the central processor to corresponding data.

5. The device according to claim 1, wherein provided in the central or in the local receiving unit is a comparator which compares the voltage applied to the power supply line, or a voltage proportional thereto, to a reference voltage.

6. The device according to claim 1, wherein the voltage applied to the power supply line is applied in the local control unit through a diode to a capacitor which is connectable through the first local switch to the electric motor.

7. The device according to claim 1, wherein the electric motor is provided with a sensor, by which the rotations and rotational direction of the rotor, and thus the path traveled by the divider element and the encountering of an obstacle, end stop or adjacent divider element are able to be measured.

8. A method to control at least one divider element which is retained by a drive assembly guided within a track and driven by an electric motor, including a central control unit and a local control unit connected to the divider element, each of the control units exchanging data by means of a central or local processor through a power supply line which functions as the power supply for the electric motor, wherein provided in the central control unit is a first direct voltage which is connectable through a central switch to the power supply line, the switch being actuated by a central sending unit as a function of the data to be transmitted from the central control unit to the local control unit; and that provided in the local control unit is local receiving unit which is capable of detecting changes in the voltage applied to the power supply line, which changes are converted by a local processor into appropriate data, the processor being connected to a first local switch by which the voltage applied to the power supply line is connectable to the electric motor.

9. The method according to claim 8, wherein provided in the local control unit is a local sending unit by which data are transmitted through the power supply line to a central receiving unit provided in the central control unit during intervals in which the central switch is opened.

10. The method according to claim 9, wherein in the central control unit a second direct voltage is permanently connected through a central resistance to the power supply line to which a local resistance is able to be connected by a second local switch in the local control unit, the switch being actuated by the local sending unit as a function of the data to be transmitted.

11. The method according to claim 10, wherein the central receiving unit detects changes in the voltage applied to the power supply line, the changes being converted according to a second transfer protocol by the central processor to corresponding data.

12. The method according to claim 8, wherein data packets are transmitted by the central control unit to the local control unit, which packets have a start bit generated by temporarily opening the central switch.

13. The method according to claim 12, wherein the at least one local control unit is able to transmit at least one data bit to the central control unit during the occurrence of bits, having the start bit, or within synchronously or asynchronously occurring time windows assigned generally or individually to the local control units, in which windows the central switch is opened.

14. The method to control the device provided with multiple divider elements according to claim 8, wherein in order to initialize the device the divider elements are moved individually in the predetermined sequence manually, towards the park position assigned to them, this action being detected by the sensor and reported by the local control unit to the central control unit which records the rank number of the local control unit and its displacement direction relative to the park position, then assigns an address to this number which is stored in the central or local control unit.

15. The method according to claim 14, wherein the central control unit moves each divider element sequentially towards a stop in order to determine the end position, and that the central control unit extends the divider elements out of the parking space until they meet a stop which is recorded as the outer end position, after which, based on the inner and outer end positions assigned to each divider element, the element's position within the travel path is determined and the element is controlled in order to reduce the travel speed before reaching the target position.

16. The method according to claim 14, wherein the central control unit transports the divider elements from the outer end positions at a predetermined speed and predetermined intervals towards the associated park position, records the time intervals of their arrival at the inner end positions, and stores this in the central and/or the at least one local control unit, after which these time intervals are used to delay the extension of the divider elements from the park positions in order to avoid collisions there.

* * * * *